US006550148B2

(12) United States Patent
Cecil

(10) Patent No.: US 6,550,148 B2
(45) Date of Patent: Apr. 22, 2003

(54) SHAVING METHOD AND APPARATUS

(76) Inventor: Corbett W. Cecil, 8085 Elmwood Cove, Olive Branch, MS (US) 38654

( * ) Notice: Subject to any disclaimer, the term of this patent is extended or adjusted under 35 U.S.C. 154(b) by 0 days.

(21) Appl. No.: 09/929,659

(22) Filed: Aug. 15, 2001

(65) Prior Publication Data

US 2003/0033717 A1 Feb. 20, 2003

(51) Int. Cl.[7] ..... B26B 21/52

(52) U.S. Cl. ..... 30/526; 30/50

(58) Field of Search ..... 30/541, 526, 41, 30/298, 340, 535, 527, 50

(56) References Cited

U.S. PATENT DOCUMENTS 6,029,356 A * 2/2000 Sprinkle ..... 30/526 X

* cited by examiner

*Primary Examiner*—Douglas D. Watts
(74) *Attorney, Agent, or Firm*—John J. Mulrooney

(57) ABSTRACT

A shaving razor comprises a finger grip consisting of a body having contoured sides, a top surface and a base. A razor head is affixed to the top surface. The finger grip sides are concave in shape to conform to and accommodate the shape of the user's fingers. When the finger grip is held between the user's fingers and the razor head is placed against the skin, the user's fingers are capable of contacting the skin adjacent to the razor head to provide sensory feed back to the user. The razor head is adapted to contain one or more blades, or pairs of blades, extending in a single direction for unidirectional shaving; or alternatively, the head may contain more than one blade, or pairs of blades, extending in opposite directions for bi-directional shaving. In different embodiments, the finger grip razor may be fitted with non-replaceable blades and is disposable or the razor grip may be fitted with replaceable blades and is reusable. In different embodiments, the head and/or the blades on the head are pivotally mounted with respect to the finger grip. In another embodiment, a razor head is affixed at each end of the finger grip. The design of the razor grip permits safe unidirectional shaving using a conventional pull shaving stroke, and safe bi-directional shaving using both pull and push cut strokes. A shaving substance may be stored within the finger grip to be selectively dispensed directly to the razor head and onto the user's skin during shaving. In another embodiment, a bar of shaving substance is affixed to the base of the finger grip.

18 Claims, 2 Drawing Sheets

SHAVING METHOD AND APPARATUS

BACKGROUND OF THE INVENTION

1. Field of the Invention

The present invention relates generally to a method for shaving hair and to apparatus consisting of unidirectional and bi-directional razors useful to practice that method. In particular, the present invention relates to a method for shaving body parts in which a finger grip razor is contoured to be held between the user's fingers in such a manner that the user's fingers are capable of continuous or selective contact with the user's skin during the shaving strokes; and to apparatus comprising a finger grip razor contoured to conform to the shape of the user's fingers so that the method of the present invention can be practiced.

2. Information Disclosure Statement

Razors capable of shaving hair off of parts of the body are well-known. Typically, a razor consists of an elongated handle designed to be held in the hand between the thumb and forefinger of the user, and having a razor head with one or more transversely extending blades affixed at one end of the handle. The prior art includes razors in which pairs of blades extend in one direction to permit shaving only in one direction, and also includes razors in which pairs of blades extend in opposite directions whereby the user may move the razor head in one direction for contacting one pair of blades against the use's skin for cutting hair and then, without lifting the razor head from the skin, move the handle in the opposite direction so that the other pair of blades cuts hair during the reverse movement of the razor. The prior art also includes finger-mounted razors in which blade-holding razor heads are mounted on rings which slide over the user's fingers.

A preliminary patentability search produced the following patents, which may be relevant to the present invention: Lishawa, U.S. Pat. No. 1,201,317, issued Oct. 17, 1916; Brown, U.S. Pat. No. Des. 146,759, issued May 13, 1947; Sceberras, U.S. Pat. No. 4,501,066, issued Feb. 26, 1985; Lazarus, U.S. Pat. No. Des. 281,282, issued Nov. 5, 1985; Monistere, U.S. Pat. No. 5,357,680, issued Oct. 25, 1994; Doyle, U.S. Pat. No. Des. 386,819, issued Nov. 25, 1997; Andrews, U.S. Pat. No. 5,865,189, issued Feb. 2, 1999; Andrews U.S. Pat. No. 5,979,056, issued Nov. 9, 1999; Greene, U.S. Pat. No. 6,018,877, issued Feb. 1, 2000; Sprinkle, U.S. Pat. No. 6,029,356, issued Feb. 29, 2000; and Greene, U.S. Pat. No. 6,112,421, issued Sep. 5, 2000.

However, none of the known prior art razors teach the use of a shaving method and apparatus utilizing a finger grip razor that is sized and contoured to snugly and comfortable fit between fingers of the user's hand so as to permit the user's fingers to contact the shaved surface, thereby allowing safe bi-directional shaving using reciprocating pull and push cut strokes without having to lift the razor from the user's skin and without having to worry about orienting the finger grip and/or razor head at a critical or safe angle with respect to the user's skin surface.

The known prior art devices do not teach either the method or apparatus or the present invention and do not provide the benefits of utility, safety, control, efficiency and economy that are inherent in the method and apparatus of the different embodiments of the finger grip razor of the present invention. Neither the finger-mounted nor conventional elongated handle razors of the prior art provide the safety or control that is obtainable with the finger razor of the present invention, particularly when shaving parts of the body that are difficult to reach and/or not visible.

None of the known prior references, either singly or in combination, disclose or suggest the present invention.

It is therefore desirable to provide a method of shaving wherein a finger grip razor is contoured to fit between the user's fingers and permits the user's fingers to contact the surface being shaved for the safe and efficient shaving of both visible and out-of-sight body parts, and contoured parts, and a razor apparatus capable of performing that method.

BRIEF SUMMARY OF THE INVENTION

The present invention comprises apparatus for and a method of shaving in which a finger grip razor is contoured to fit between and to receive and cradle the user's fingers whereby both the razor head and the user's fingers are capable of contact with the user's skin during the shaving strokes so that the user can determine the closeness of the shave so far obtained and also obtain sensory feedback as to whether or how the contour of the shaved surface is changing and as to whether additional shaving of the area is necessary or desirable. The combination of the between-finger contoured design of the finger grip razor, and the capacity of the fingers to touch the skin, permits extremely close motion and pressure control of the razor, particularly on difficult-to-reach body parts that can not be seen and/or where the body contour changes sharply or frequently. The finger grip razor has two opposed sides that are contoured to have generally concave shapes to fit snugly and comfortably between the generally convex shapes of the user's fingers. A razor head is affixed at the end of the finger grip between the two contoured sides. The razor head may contain a single or multiple blades for unidirectional shaving or a single or multiple pairs of blades extending in opposite directions for bi-directional shaving. The finger grip razor may be disposable or the razor head may contain replaceable blades or cartridges, whereby the finger grip and/or head are made reusable by the feature of changeable blades. The design of the razor is such that when the razor head contacts the user's skin during a shaving stroke, the user's fingers are capable of contacting the skin adjacent the area being shaved, thereby enabling the user to detect and adjust for any changing contour of the body, and to sense whether uncut hair remains and, if so, to determine the proper shaving motion and direction and to apply the necessary amount of pressure to obtain a safe shave having the desired closeness.

It is an object of the present invention to provide a shaving method and apparatus comprising a finger grip razor having opposed generally concave sides that are contoured to fit between the generally convex shapes of the user's fingers and to cradle the user's fingers to provide for an enhanced degree of motion control over the razor and the shaving stroke.

It is another object of the present invention to provide a razor capable of either unidirectional or bi-directional shaving.

It is another object of the present invention to provide a razor that permits simultaneous contact between the user's fingers and the shaved surface during shaving to provide sensory feedback regarding the necessity or desirability of additional shaving strokes.

It is another object of the present invention to provide a razor that is capable of safe and easy manipulation on difficult-to-reach body parts, particularly body parts that are not visible.

It is another object of the present invention to provide a razor that provides enhanced capacity to shave body parts where the contour of the body changes sharply, such as those parts of the face around and under the chin, nose, and jaw.

It is another object of the present invention to provide a razor which may be disposable or may be reusable through the feature of a replaceable head or replaceable blades on the head.

It is another object of the present invention to provide a razor having the feature of pivoting blades.

It is another object of the present invention to provide a razor having a blade or multiple pairs of blades aligned in only one direction, or having a blade or multiple pairs of blades aligned in opposite directions.

It is another object of the present invention to provide a razor having a replaceable blade feature and that is capable of using commercially available razor cartridges.

It is another object of the present invention to provide a razor having a razor head affixed to each end of the razor finger grip.

It is another object of the present invention to provide a razor having a finger grip capable of containing a shaving substance which may be selectively dispensed onto the user's skin during shaving.

It is another object of the present invention to provide a razor having the feature of a bar of shaving substance affixed to the finger grip.

DETAILED DESCRIPTION OF THE INVENTION

Figure 1:
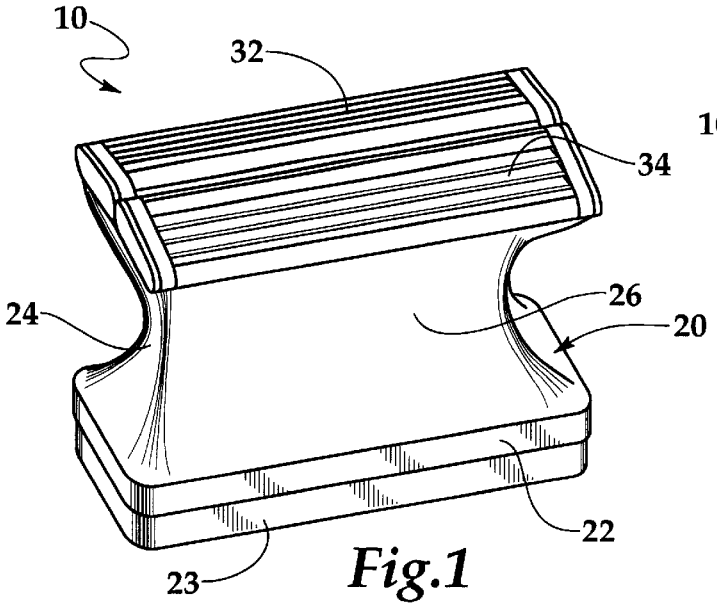
FIG. 1 is a perspective view of the finger grip razor in accordance with one embodiment of the present invention in which the razor head and blades thereon are aligned substantially parallel to the concave sides of the finger grip in which the user's fingers are placed.

In describing the embodiments of the invention by reference to the several figures of the drawings, the same reference numerals are used to designate the same elements appearing in the several embodiments of the invention. Also, referring to the drawings, it will be seen that each embodiment of the finger grip razor the present invention is symmetrical about its vertical centerline.

Figure 2:
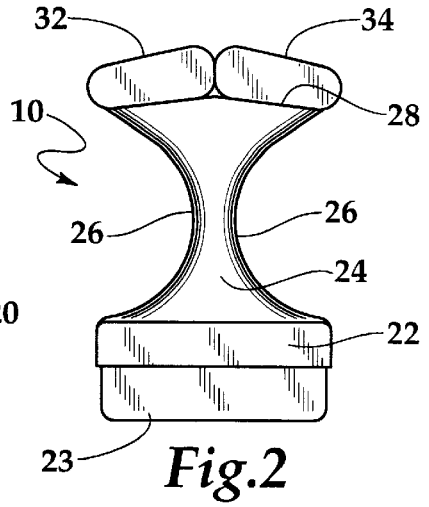
FIG. 2 is an end elevation view of the finger grip razor illustrated in FIG. 1.
Figure 3:
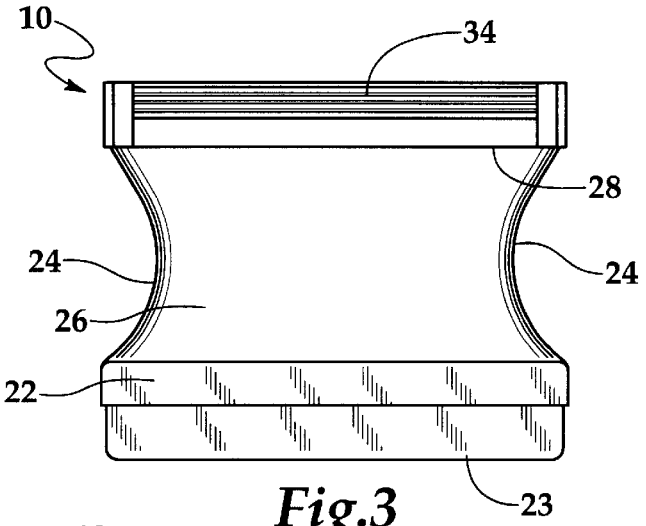
FIG. 3 is a side elevation view of the finger grip razor illustrated in FIG. 1.
Figure 4:
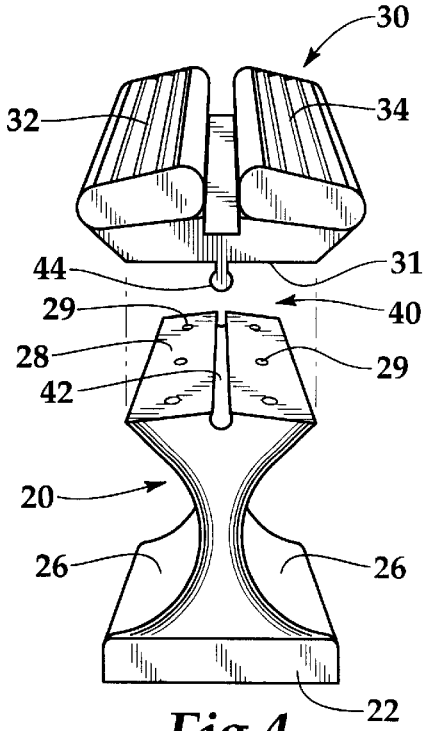
FIG. 4 is an exploded view of a finger grip razor of the present invention showing a latching means that is useful to both mount the razor head on the finger grip and to provide for pivoting of the razor head with respect to the finger grip.

Referring to FIGS. 1–3, one embodiment of the present invention comprises a finger grip razor indicated generally by the numeral 10, having a finger grip body indicated generally by the numeral 20, and a razor head indicated generally by the numeral 30 (FIG. 4). The finger grip body 20 has a foot or base 22, ends 24, opposing contoured sides or necks 26 and a top surface 28. The top surface 28 has a slight inward and upward pitch as illustrated to provide a pitch to the blades mounted thereon. Alteratively, the inward and upward pitch to the blades may be provided by the design of the razor head 30 or by the blade cartridges received by the head 30. The head 30 is mounted on the top surface 28 of finger grip 20 between the two contoured sides 26 and has a first pair of blades 32 facing in one direction and a second pair of blades 34 facing in the opposite direction, whereby the razor is useful for both unidirectional shaving using a pull or draw shaving stroke and for bi-directional shaving using alternating draw and push shaving strokes. In the embodiment illustrated in FIGS. 1–3, the razor head 30 and blades 32 and 34 mounted thereon are aligned substantially parallel to the contoured sides 26 of the finger grip 20. A bar 23 of a substance suitable for shaving such as soap may be affixed to the bottom of the base 22.

Experimentation has shown that, because of the inherent compatibility and receptivity between the generally concave shape of the finger grip sides 26 and the generally convex sides of the user's fingers, literally one size of the finger grip invention fits all users. Nevertheless, it will be appreciated that the present invention may be constructed in different sizes. The dimensional proportions of the finger grip 20 should be such that the concave sides 26 will receive in cradle-like fashion the sides of the fingers of the user and, when the razor head 30 is placed against the skin, the leading finger, i.e., the finger in advance of the razor head 30 with respect to the direction of travel of the razor head, will be capable of contacting the skin in advance of the razor head 30 during the shaving stroke. Prototype models having dimensions of approximately one (1") inch in height (measured from base 22 to top surface 28), widths of three-fourths (¾") inch for the base 22 and top surface 28, and a length of one and three-fourths (1¾") inches for the base 22 and top surface 28, have been found to function satisfactorily and to provide all of the useful benefits described herein.

Figure 7:
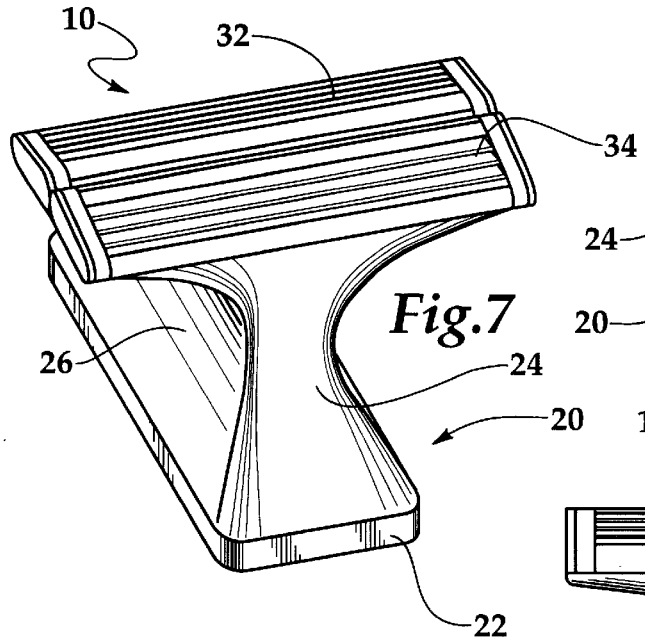
FIG. 7 is a perspective view of another embodiment of the finger grip razor of the present invention in which the razor head and blades thereon are aligned substantially perpendicular to the concave sides of the finger grip in which the user's fingers are placed.
Figure 8:
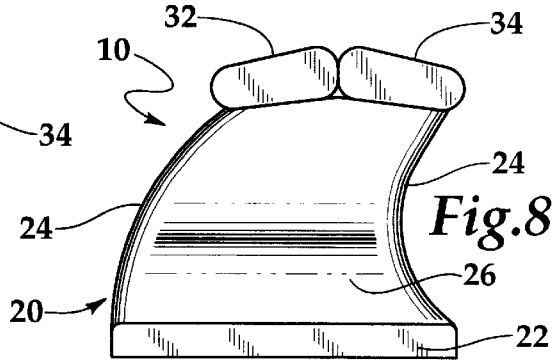
FIG. 8 is a side elevation view of the finger grip razor illustrated in FIG. 7.
Figure 9:
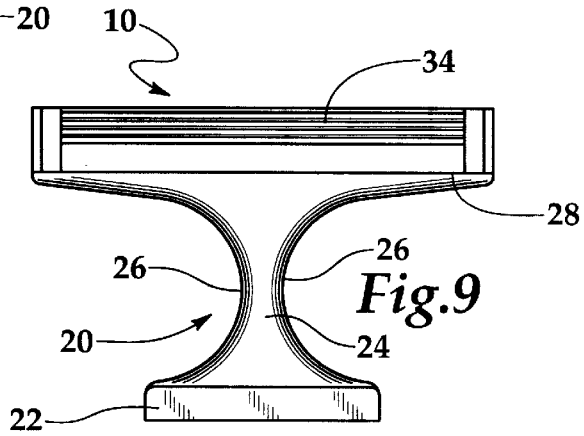
FIG. 9 is an end elevation view of the finger grip razor illustrated in FIG. 7.

Referring to FIGS. 7–9, another embodiment of the present invention is disclosed in which the blades 32 and 34 mounted on the razor head are aligned substantially transversely to the contoured sides 26 of the finger grip 20. All of the descriptions and disclosures made in connection with the construction and features of the embodiment illustrated in FIGS. 1–3 apply to the embodiment shown in FIGS. 7–9. The only difference between the embodiments disclosed in FIGS. 1–3 and FIGS. 7–9 is the alignment or orientation of the blades with respect to the contoured sides 26 of the finger grip 20 and the fingers holding the finger grip razor. The method of using the different embodiments shown in FIGS. 1–3 and FIGS. 7–9 is the same.

Figure 10:
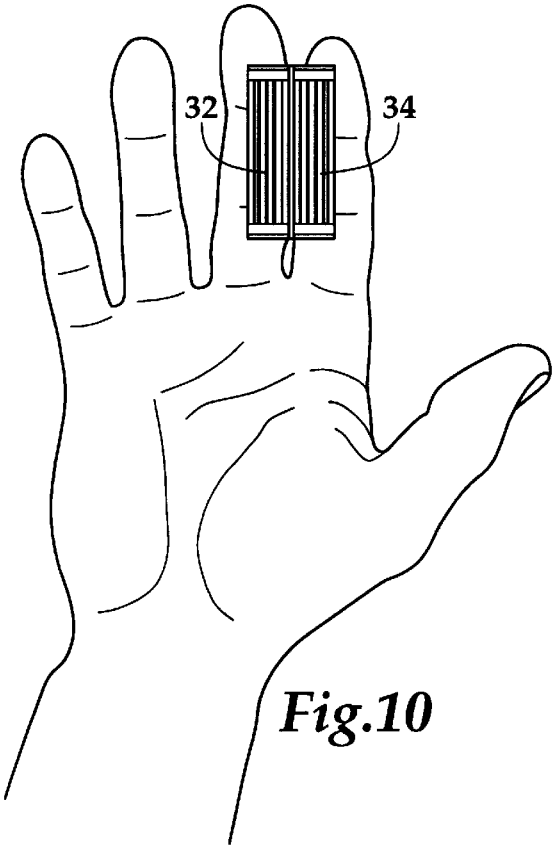
FIG. 10 illustrates one technique for holding and using the finger grip razor of the present invention wherein the blades of the razor are on the palm side of the fingers.
Figure 11:
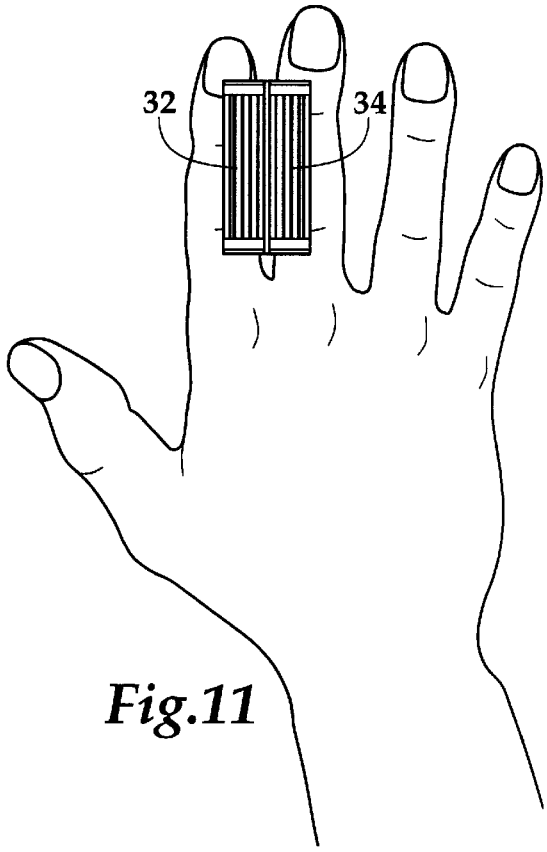
FIG. 11 illustrates another technique for holding and using the finger grip razor of the present invention wherein the blades of the razor are on the backhand side of the fingers.

The preferred technique for shaving with the present invention, as illustrated in FIGS. 10–11, is to hold the finger grip 20 between two adjacent fingers, such as the index and middle fingers. However, it will be appreciated by those skilled in the art that the finger grip razors disclosed herein are capable of producing the benefits described when held between any two fingers, such as, for example, the thumb and the middle finger.

The finger grip 20 may be a permanent finger grip provided with a replaceable head 30, or replaceable blades on the head, or the finger grip 20 and head 30 may comprise an integral, disposable unit. Finger grip 20 may be made of metal, plastic, ceramics, rubber, wood, or any combination of such materials, suitable to withstand the uses, handling and environment to which wet shaving razors are customarily exposed. The contoured sides 26 may be constructed of a softer pliable material for comfort and may have a textured surface to provide a non-slip grip.

The finger grip 20 may be constructed in whole or in part of a pliable material and provided with a hollow interior (FIG. 6) to provide a shaving substance storage chamber 50 for storing a supply of lubricating or shaving substance such as shaving cream, lotion, shaving gel or other lubricating substance therein. During use, lubricating substance stored in chamber 50 may be dispensed onto the head and user's skin by the application of a squeezing force on the finger grip sides 26 during use.

It will be appreciated by those skilled in the art of shaving apparatus, that head 30 may have one or more blades oriented for unidirectional shaving, or may have a plurality of pairs of blades oriented in opposite directions to permit bi-directional shaving. The head 30 may be permanently affixed to finger grip 20 or, alternatively, head 30 may be releaseably mounted on top 28 of the finger grip 20 such as by well-known spring loaded clips (not shown) used to releasably mount blade cartridges on conventional razors. When head 30 is integrally affixed to finger grip 20, the blades 32 and 34 may be releasably mounted thereon such as by spring loaded clips or other well-known techniques to provide a replaceable razor, or the blades 32 and 34 may be non-replaceable to provide a disposable razor. Alternatively, the head 30 itself may comprise blade cartridge units that are either releasable affixed directly to the top 28 of finger grip 20 such as by spring loaded clips or other well-known techniques to provide a replaceable blade feature, or blade cartridge units may be permanently affixed atop finger grip 20, whereby the razor 10 will be a disposable unit. Also, as discussed below, the head 30 and/or the blade cartridge units may be pivotally mounted on head 30 or immovably affixed to top surface 28.

It will be appreciated by those skilled in the art that means such as a plurality of paths or water ways may be provided to purge the razor of shaving debris by flushing the razor with water, thereby preventing the clogging of the head with shaved debris. Such water ways may consist of channels or grooves in the top surface 28, or the razor head 30 or disposable blade cartridges used with head 30 may have such paths constructed therein.

Referring to FIG. 4, an exploded view of the finger grip razor of the present invention illustrates a latching means useful to removably connect the razor head 30 to the razor finger grip 20 in either a pivoting or non-pivoting relationship. A latching means for attaching head 30 to finger grip 20 is a mechanism indicated generally by the reference 40 consisting of a longitudinal, cylindrical groove 42 in finger grip top surface 28 that extends the full length of razor finger grip 20 and a cylindrical shaped tongue 44 that extends along the full length of the bottom of razor head 30. The groove 42 is designed and sized to receive and retain the tongue 44 in a sliding relationship. The mechanism 40 provides both a latching means for affixing razor head 30 to razor finger grip 20 and a means for allowing razor head 30 and the blades thereon to pivot with respect to finger grip 20. By constructing the groove 42 and cylindrical tongue 44 so that no gap appears at the interface of the bottom surface 31 of head 30 and the top surface 28 of finger grip 20, the head 30 will not pivot with respect to finger grip 20. By modifying the dimensions of the groove 42 with respect to the dimensions of the cylindrical tongue 44, a gap may be made to occur at the interface of the bottom surface 31 of head 30 and the top surface 28 of finger grip 20, whereby the head 30 will pivot with respect to finger grip 20. The latching mechanism 40 makes the head 30 and blades thereon removable and replaceable with respect to the finger grip 20. It will be apparent to those skilled in the art that other means for permitting head 30 and/or the blades thereon to pivot with respect to finger grip 20 are within the scope of the present invention.

Figure 5:
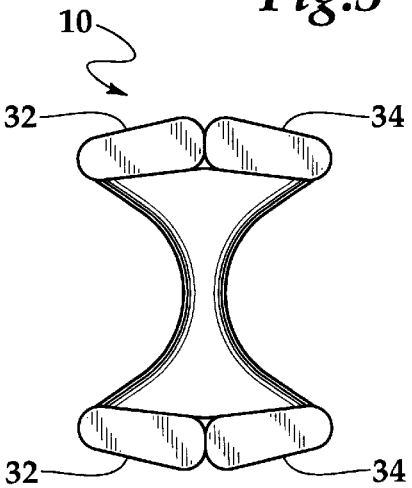
FIG. 5 is an end elevation view of a finger grip razor constructed according to another embodiment of the present invention in which a razor head is affixed at each end of the razor finger grip.

In the embodiment shown in FIG. 5, the finger grip 20 has a razor head 30 with blades 32 and 34 mounted at both ends thereof to provide a razor having a shaving capacity at either end. It will be appreciated that all of the features previously disclosed with respect to the other embodiments such as replaceable blades, unidirectional and bi-directional blades, pivoting and non-pivoting blades are all applicable to the dual ended razor shown in FIG. 5. This dual ended razor will be seen to provide a particular benefit of economy when featured in a disposable razor because of the double shaving capacity provided by the additional blades. While the dual ended razor shown in FIG. 5 has the head 30 and blades thereon aligned substantially parallel to the contoured sides of finger grip 20, it will be recognized that it will be possible to make a dual ended finger grip razor in which the head 30 and blades thereon are aligned substantially perpendicular or transversely to the contoured sides 26 of finger grip 20.

It will be appreciated by those skilled in the art that all of the embodiments of the present invention may be provided with a clip-on protective safety cover for the razor head 30 to protect against cuts when the razor is not in use.

Figure 6:
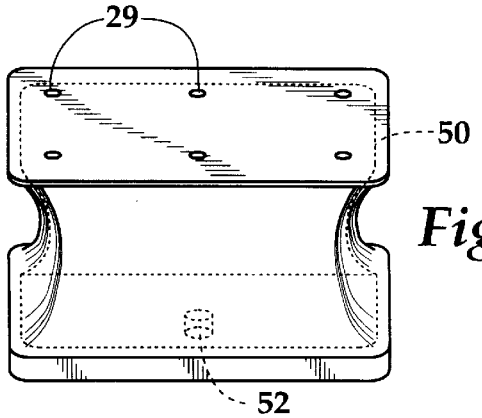
FIG. 6 is a perspective view of the finger grip razor of the present invention wherein the finger grip has hollow chamber therein for containing a supply of shaving substance that may be dispensed during shaving directly to the razor head and onto the skin of the user.

In the embodiment shown in FIG. 6, the finger grip 20 is hollow and contains a chamber, indicated by the dotted line 50, to provide for the storage of a lubricating shaving substance such as shaving cream or shaving gel therein. A removable plug 52 in the base 22 of finger grip 20 permits the shaving substance storage chamber 50 to be filled with a shaving substance and allows the dispensing of that shaving substance as needed for shaving. A plurality of holes 29 in the top surface 28 of finger grip 20 (FIGS. 4 and 6) may be provided to allow the selective dispensing of the shaving substance directly into the razor head 30 and onto the skin during shaving.

In use, the finger grip 20 will be held between two fingers, such as the forefinger and the middle finger, and the razor head 30 may be positioned on either the palm side of the fingers as shown in FIG. 10 or the backhand side of the fingers as shown in FIG. 11. The head 30 will then be placed against the skin and the edge of the finger on the leading side of the finger grip 20 will touch the skin in advance of the head 30. The user will then move the head 30 along the skin using a pull stroke, or the user may move the head 30 along the skin using alternating pull strokes and push strokes without removing the head from its shaving position against the user's skin. During the shaving strokes, the contact between the user's leading finger and skin permits the user to control the razor with respect to the pressure being applied to determine the closeness of the shave, and to manipulate the razor at places where the contour of the surface being shaved changes shape and contour sharply or frequently to provide for a safe shave. During the shaving strokes, the user may selectively apply shaving substance directly to the skin by squeezing the finger grip 20 to dispense the shaving substance contained therein. If the embodiment having the shaving bar affixed to the base 22 is being used, the user will moisten the skin and rub the bar against to skin to apply the shaving substance as needed.

Although the present invention has been disclosed and illustrated with respect to specific embodiments and a preferred use for such embodiments, it is not to be so limited since modifications and changes can be made therein which are within the full intended scope of the invention.

I claim:

1. A method of shaving comprising:

(a) providing a razor having a finger grip with opposed concave sides and a razor head affixed to the finger grip between said concave sides, said razor head having at least one blade thereon;

(b) holding the finger grip between two fingers with the fingers abutting the concave sides and the said two fingers being substantially parallel to said blade;

(c) placing the razor head against the skin so that the leading finger is capable of contacting the skin in advance of the razor head; and (d) moving the razor head along the skin with the razor head and the leading finger maintaining continuous contact with the skin.

2. A method of shaving as in claim 1, wherein:

as part of step (a), a razor head is provided that has at least two blades with a first blade being oriented in one direction and the second blade being oriented in the opposite direction; and as part of step (d), the finger grip is moved along the skin alternately in opposite directions using push and pull shaving strokes.

3. A method of shaving as in claim 1, wherein:

as part of step (a), a razor head is provided that has a plurality of blades with equal numbers of blades oriented in opposite directions; and as part of step (d), the finger grip is moved along the skin alternately in opposite directions using push and pull shaving strokes.

4. A method of shaving as in claim 1, wherein:

as part of step (a), a finger grip is provided that has a shaving substance storage chamber with a supply of shaving substance; and including the step of (e) selectively dispensing said shaving substance.

5. A method of shaving as in claim 1 further comprising the step of providing a bar of shaving substance on said finger grip base.

6. A method of shaving as in claim 1, wherein:

as part of step (a), a finger grip is provided where the razor head is pivotable with respect to the finger grip.

7. A method of shaving as in claim 1, wherein:

as part of step (a), the razor head is removably attached to the finger grip.

8. A method of shaving as in claim 1, wherein:

as part of step (b), the fingers abutting the concave sides of the finger grip are oriented transversely to said blade.

9. A shaving apparatus comprising a finger grip having two opposed finger-receiving concave sides; a top end and a bottom end; and a razor head affixed to said top end of the finger grip, said head having at least one blade thereon, wherein said blade is disposed substantially parallel to the concave sides of said finger grip.

10. A shaving apparatus comprising a finger grip having two opposed finger-receiving concave sides; a top end and a bottom end; and a razor head affixed to said top end of the finger grip, said head having at least one blade thereon, whereby, when said finger grip is held between two fingers and said razor head is placed against the skin, the leading finger is capable of contacting the skin in advance of the head during the shaving strokes.

11. A shaving apparatus comprising a finger grip having two opposed finger-receiving concave sides; a top end and a bottom end; and a razor head affixed to said top end of the finger grip, said head having at least one blade thereon, wherein said razor head has at least two blades with a first blade being oriented in one direction and a second blade being oriented in the opposite direction, whereby bi-directional shaving is possible by moving said razor head along the skin alternately in opposite directions using push and pull shaving strokes, and said head is pivotable with respect to said finger grip.

12. A shaving apparatus comprising a finger grip having two opposed finger-receiving concave sides; a top end and a bottom end; and a razor head affixed to said top end of the finger grip, said head having at least one blade thereon, wherein said finger grip has a shaving substance storage chamber therein and means associated with said finger grip allow said shaving substance to be selectively dispensed from said storage chamber.

13. A shaving apparatus comprising a finger grip having two opposed finger-receiving concave sides; a top end and a bottom end; and a razor head affixed to said top end of the finger grip, said head having at least one blade thereon; and a second razor head affixed to said finger grip at said bottom end of said finger grip, said second razor head having at least one blade thereon.

14. A razor comprising a finger grip having a top side, two opposed finger-receiving concave sides and a bottom side; and a razor head affixed to said finger grip top side, said razor head having at least one blade thereon, whereby when said finger grip is held by placing a finger in each of said concave sides and said razor head is placed against the skin, the leading finger also contacts the skin in advance of said razor head.

15. A shaving apparatus comprising a finger grip having two opposed finger-receiving concave sides; a top end and a bottom end; and a razor head affixed to said top end of the finger grip, said head having at least one blade thereon, wherein said razor head has a shaving substance storage chamber therein and orifices in said top surface to permit shaving substance to be selectively dispensed from said storage chamber onto said razor head and skin.

16. The shaving apparatus in accordance with claim 14, further comprising latching means for attaching said razor head to said finger grip whereby said razor head is both removably and pivotably attached to said finger grip.

17. The shaving apparatus in accordance with claim 14, wherein said blade is oriented transversely to said concave sides.

18. The shaving apparatus in accordance with claim 17, wherein said blade is oriented substantially parallel to said concave sides.

* * * * *